US005625896A

United States Patent [19]

LaBarbera et al.

[11] Patent Number: 5,625,896

[45] Date of Patent: May 6, 1997

[54] LIGHT WEIGHT SHIN PROTECTOR

[76] Inventors: Joseph P. LaBarbera, 1001 Symphony Isles Blvd.; William C. Relihan, 817 Chipaway Dr., both of Apollo Beach, Fla. 33572

[21] Appl. No.: 509,784

[22] Filed: Aug. 1, 1995

[51] Int. Cl.[6] ..... A41D 13/00

[52] U.S. Cl. ..... 2/22

[58] Field of Search ..... 2/2, 16, 22, 23, 2/24

[56] References Cited

U.S. PATENT DOCUMENTS

| | | | |
|---|---|---|---|
| 3,189,919 | 6/1965 | Chase | 2/22 X |
| 4,001,953 | 1/1977 | Fugere et al. | 2/22 X |
| 4,756,026 | 7/1988 | Pierce, Jr. | 2/24 X |
| 5,297,294 | 3/1994 | Washick | 2/24 X |
| 5,423,087 | 6/1995 | Krent et al. | 2/2 |

FOREIGN PATENT DOCUMENTS

| | | | |
|---|---|---|---|
| 4128958 | 3/1993 | Germany | 2/22 |

*Primary Examiner*—Paul C. Lewis
*Attorney, Agent, or Firm*—Dominik & Stein

[57] ABSTRACT

A shin protector designed to be worn for extended periods of time without discomfort, for protecting the shin area against minor impacts. The shin protector protects its user from abrasions and wounds that may result from everyday activity and is especially useful for the elderly.

1 Claim, 5 Drawing Sheets

LIGHT WEIGHT SHIN PROTECTOR

BACKGROUND OF THE INVENTION

1. Field of the Invention

The present invention is directed to a shin protector, and more particularly, a light weight shin protector which can be comfortably worn for extended periods of time.

2. Description of the Related Art

Advances in medicine have extended the average life-span. The elderly population has increased steadily to where there are now millions of Americans over the age of 65. Even in healthy individuals, advancing age is frequently accompanied by weakening of the bones, slowing of the circulation, arthritis, insufficient nutrition, a tendency to be less active, diminution of muscle tissue and physical coordination, and an increased likelihood of sustaining injuries resulting from disorientation or loss of balance. With age, the time required to recover from incapacitating physical or mental afflictions becomes longer and longer.

Many elderly are chronically ill, and reside in assisted living facilities or skilled nursing facilities. The prolonged recovery time is usually accompanied by long periods of internment and inactivity. This inactivity leads to further reduction in muscle and skin tone, loss of circulatory vitality, and diminished physical coordination.

As infirm elderly patients move about in their home or in unfamiliar day care centers or hospitals, they tend to bump themselves. This may not sound like a problem. However, minor injuries that can be ignored or require no more than a band-aid in the majority of the population tend to cause serious problems in the elderly. The reduced skin strength can mean that even a minor bump can produce a serious gash. The reduced circulation and reduced healing rate can turn a small gash or bump into an infected and life-threatening wound or phlebitis. The reduced bone strength can mean that even a minor bump can result in bone fractures.

Most of these injuries occur in the vicinity of the shin, a highly exposed and unprotected area.

Wounds caused by skin-tears and abrasions are so prevalent among the elderly that a specialized new industry has come into existence—wound-care clinics. The clinics treat wounds by administering costly medications such as oral and intravenous antibiotics, and topical medications. Non-ambulatory patients may be treated at hospitals or at home. Therefore, the treatment of complications arising from superficial injuries suffered by the elderly can be expensive. Considering the number of elderly patients who receive government assistance for their medical expenses, the societal cost in treating such injuries is high.

Recently, there has been an effort by the government, the public, health insurance companies, and health-maintenance organizations to lower medical care costs through preventative medicine. Undoubtedly, the prevention of serious complications arising from superficial injuries, in general, and shin injuries, in particular, would be of great benefit in lowering the cost of administering health care to the elderly.

To date, no one has addressed this problem or developed a means for preventing this type of injury to the elderly. A solution to this problem is long overdue.

SUMMARY OF THE INVENTION

It is an object of the present invention to provide a device which can be worn by the elderly for extended periods of time, and which protects the shins of the elderly against minor bumps and abrasions. It is also an object of the present invention to provide a device that can specifically protect the shins of the elderly in a way which will decrease the occurrence of minor injuries, thereby preventing subsequent major or even life-threatening secondary afflictions.

Still another object of the present invention is to provide a device that is simple and intuitive to use, disposable, lightweight, comfortable, economical, and hygienic.

These and other objects are accomplished by providing a lightweight impact-absorbing shin-protector pad specifically designed to cover the shin area. The impact-absorbing pad is disposable, lightweight, can be inexpensively manufactured, and can be easily secured by an elderly person or care-giver to the shin area to be protected. The device can be worn by the elderly for extended periods of time in order to prevent superficial injuries. The pad can be worn continuously for long periods of time, i.e., from morning to night.

In a further embodiment of the invention, the impact-absorbing pad may be provided with a longitudinal pocket for receiving a slender supplemental hard shin guard shaft insert to enhance protective capabilities.

Thus, the pad enables the elderly to freely move about without fear of bruising or causing skin lesions that have the potential of evolving into life-threatening wounds.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other superficial protectors for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 1:
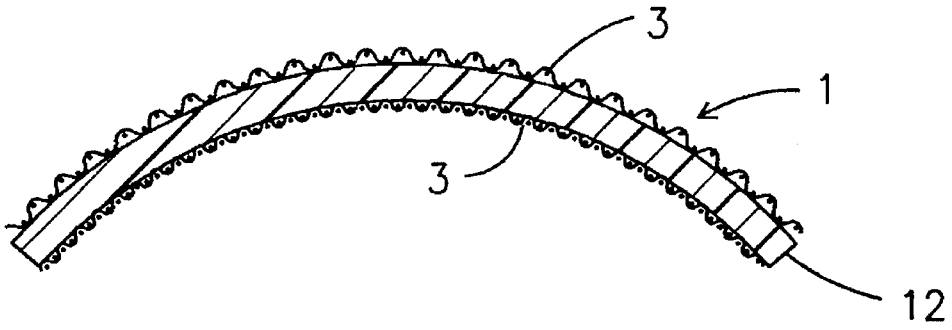
FIG. 1 is a cross-sectional view of a shin protector pad.

The present inventors constructed and experimented with various light weight shin protectors such as adhesive protectors, wire-reinforced protectors, and solid plastic protectors, and found that such devices are not comfortable enough for daily wear. Protectors which are not worn will not protect, and thus are useless. For example, it is well known to protect the shin of an athlete in a sporting activity with a device such as taught in U.S. Pat. No. 5,405,312 (Jacobs) or U.S. Pat. No. 5,301,370 (Hanson). However, these body guards were designed to be primarily used in sporting events and are entirely unsuitable for wearing for extended periods of time or by the elderly.

The present inventors discovered that the best combination of protection and comfort are to be found in a lightweight pad made of an impact-absorbing material such as foam rubber (also known as rubber sponge, cellular rubber, rubber foam, or sponge rubber), or foamed plastics. Such a pad can be easily secured to the area to be protected and can be worn continuously for extended periods of time. The logic, comfort and unobtrusiveness of the pad result in the pad being worn rather than being left in a drawer. As a result, the pad will perform it's intended function of preventing wounds and bruises.

In it's simplest form, the impact absorbing or impact attenuating pad which forms the major functional element of the present invention may be a foamed rubber (e.g., foamed neoprene, polyurethane, or polyethylene, preferably cross-linked polyethylene), or foamed plastic (e.g., foamed urea-formaldehyde, foamed polyvinyl-formaldehyde plastic, polyester resin reacted with aromatic diisocyanates to form a prepolymer which is then reacted with water to form a plastic urethane polymer which is foamed by coevolved carbon dioxide, phenolformaldehyde resin foams, and polystyrene), natural sponge, or any other such natural or synthetic material known to those in the art to have good stability, biocompatibility, resilience, and impact absorption abilities. The density of the foam layer may vary widely depending upon engineering preferences, but is preferably about 4–6 lbs. per cubic foot, most preferably about 5 lbs. per cubic foot. The layer thickness is not particularly limited, but the pad has a preferred thickness of about 1/16 to 1/4 inches. A pad thicker than 1/4 inch does not provide significant additional protection of the type with which the present invention is concerned, yet is increased in manufacturing cost and is less comfortable. A pad less than 1/8 inch in thickness is reduced in the amount of protection afforded, and less than 1/16 of an inch does not give sufficient protection.

The length of the pad from top to bottom is defined by the length of the shin area of its user to be covered. The pad can be manufactured in a one-size-fits-all configuration in which case the user can trim the pad so that it sufficiently covers the shin area, or, alternatively, the pad can be manufactured in various lengths. The length is preferably 10–14 inches, but should preferably always sufficiently cover the shin area. The width of the pad can be standardized because the width of a user's shin area will not greatly vary from user to user. Preferably, the width of the pad is 2"–6"; more preferably, the width is 3.0"–4.5"; and most preferably, the width is about 4". The width of the pad, however, will always be sufficient to cover the user's shin area.

The shin protector must be light weight. The weight of the entire shin protector is preferably 1–6 ounces, more preferably 1–5 ounces, most preferably 1.5–4 ounces. However, the weight of the entire shin protector is dependent on the materials used for its construction as well as the elements chosen for its composition, and at present the advantage of low weight materials which would reduce the weight of the shin protector to below 1.0 ounces is offset by higher cost.

Due to the ability of the manufacturer to economically produce the pads, the pads can be economically disposed of by the consumer when the pads become thoroughly worn.

In order to provide for breathability and ventilation the pad is preferably provided with perforations. The pad is cut into a shape which can be comfortably placed over the shin and which can be held in place with simple means such as cloth strips. The cloth strips are preferably provided with fastening means. For example, the overlapping ends of the cloth strips may be provided with engaging patches of hook and pile fastener materials.

In order to improve appearance, skin compatibility, comfort, and wear resistance, the pad is preferably in the form of a sandwich or laminate. The outside layers of the laminate being a fabric such as, cotton, nylon, polyester (e.g., DACRON, TERYLENE, or VYCRON), or polypropylene knit. Cotton and DACRON are the preferred fabrics in that they provide acceptable skin compatibility and launder ability. The fabric may be joined to the foam pad by application of heat and pressure, such as by a flame lamination technique where an open flame is directed to the foam material. The open flame generates sufficient heat on the surface to cause melting of the flat sheet layer. Once melted, the fabric layer is joined to the foam and the laminate is preferably run between chill rollers under sufficient pressure that the fabric and foam are permanently joined. Alternatively, an adhesive such as an epoxy or a chlorine based adhesive may be used to adhere the fabric to the foam, or the breathable fabric can be sewn to the pad at at least the periphery of the pad. One or both fabric layers are preferably also provided with perforations for improved breathabilty.

Preferred shin protectors according to the invention will now be discussed in greater detail by reference to the drawings.

FIG. 1 shows a cross-sectional view of a pad 1 which is the primary means for protecting the shin area. Being formed of planar sheet-like materials, the pad 1 at rest is planar. However, when it is secured to the shin area the pad 1 becomes deformed and adopts an arc shaped configuration shown in FIG. 1 with the concave backside of the pad 1 contacting the user's shin and the convex front side of the pad 1 exposed.

Figure 2:
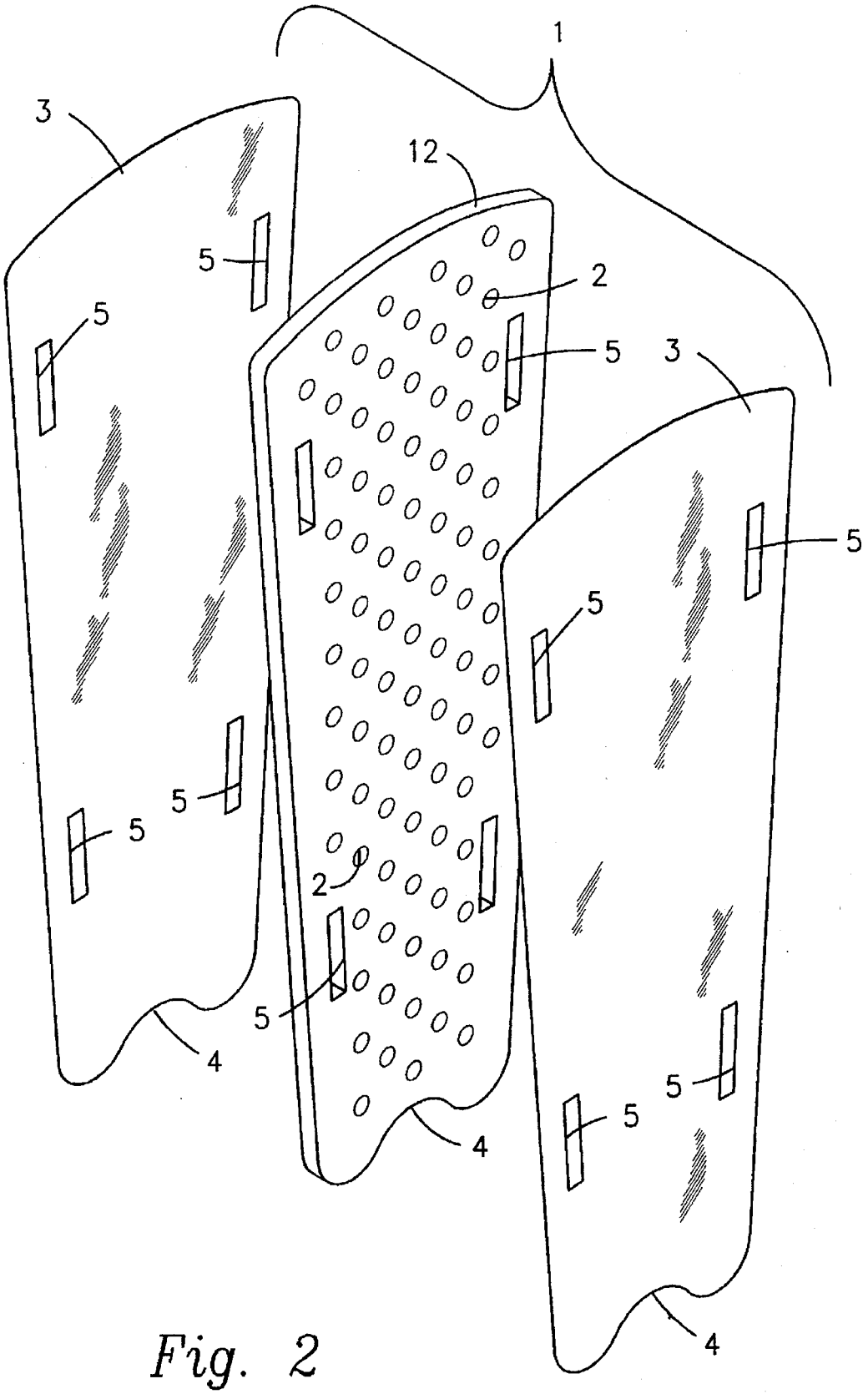
FIG. 2 is an elevated perspective view showing the layers of a typical shin protector pad.

As shown in FIG. 2, in a preferred embodiment of the invention a lower end of the pad 1 is provided with an upward recess 4. The recess 4 allows the pad 1 to fit comfortably over the arch of the foot when the pad 1 is deformed and secured to the shin area.

Furthermore, the pad 1 has perforations 2 extending through the foamed part of the pad 12. The perforations 2 are sufficient in number to afford the comfort to allow the user of the shin protector to wear the shin protector for extended periods of time (i.e., throughout the waking hours) without heat build-up or moisture accumulation at the surface of the shin. The perforations 2 are preferably circular, and the diameter of the perforations is approximately 1/16"–1/4".

A breathable fabric 3 the same shape as the foamed pad covers both the front side and back side of the foamed part of the pad 12 and may also cover the perforations 2 in the foamed part of the pad 12. The breathable fabric 3 allows for ventilation through the perforations 2 and increases the comfort and thus the time period over which the device can be worn. As a result of the incorporation of the breathable fabric 3, the pad 1 is well tolerated at the shin's surface and will also not cling to the user's clothing.

In one embodiment, the shin protector as depicted in FIG. 2 could be placed in a long knee sock such that the shin protector is held in place by the sock.

Figure 3:
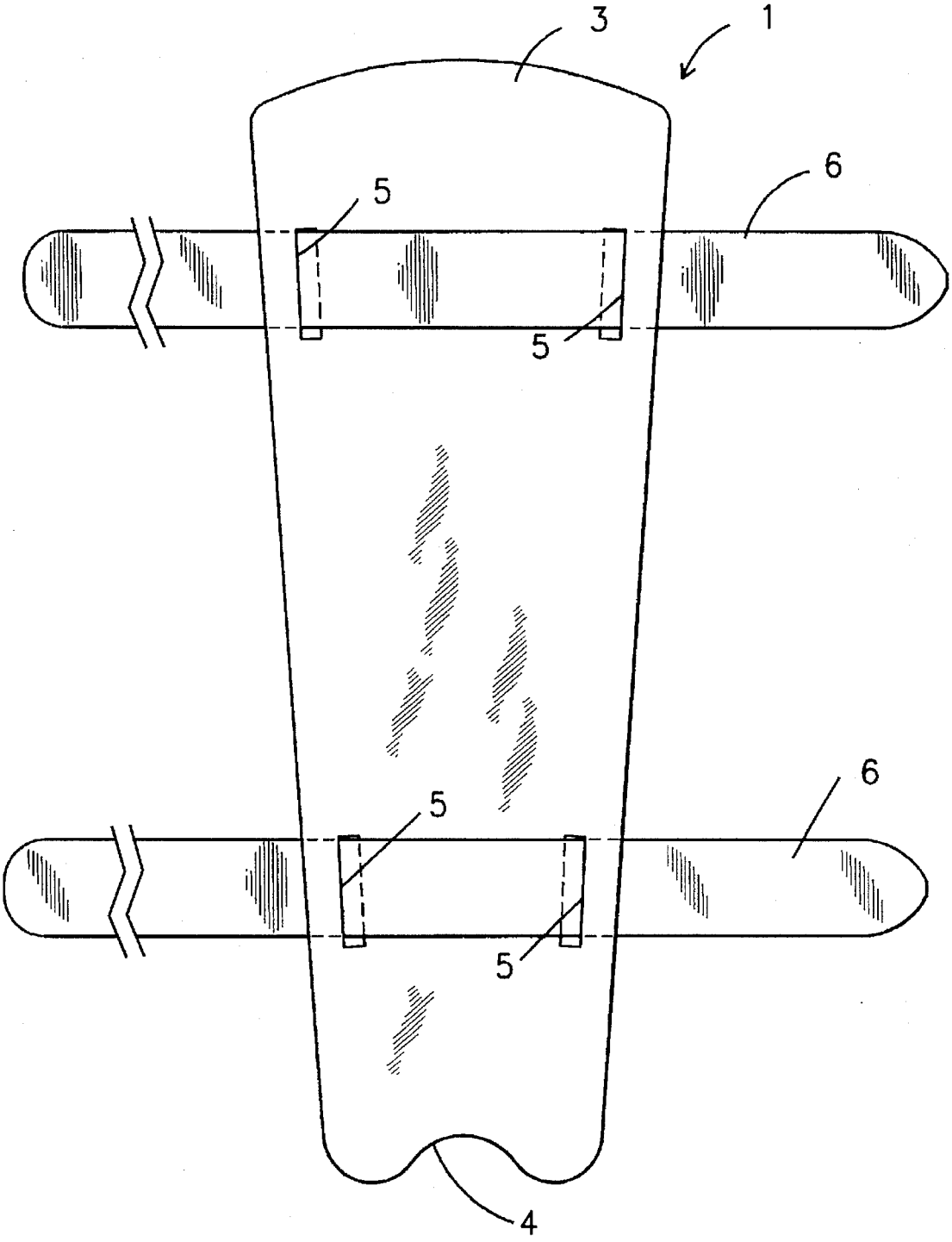
FIG. 3 is a front view of a shin protector pad with strap holding means attached.

Alternatively, as shown in FIG. 3, the device can utilize a holding means 6 to secure the shin protector to the shin area. The holding means 6 may comprise fabric straps such as webbed non-elastic material or breathable elastic straps that are placed at the lower and upper ends of the pad 1 and orthogonal to the sides of the pad 1. Two sets of straps may be attached, one set to each of the left and right sides of the pad, or one set of longer straps may be fixedly attached to one side of pad. The straps may be removable, and removable straps preferably pass through slots 5 cut into the sides of the pad 1. When the straps are wrapped around the calf portion of the leg the shin protector is held in place.

However, whatever the construction of the holding means 6, the user must be able to vary the tension within the holding means 6 so as to prevent pressure which might restrict blood circulation within the leg during extended wear by elderly users.

Figure 4:
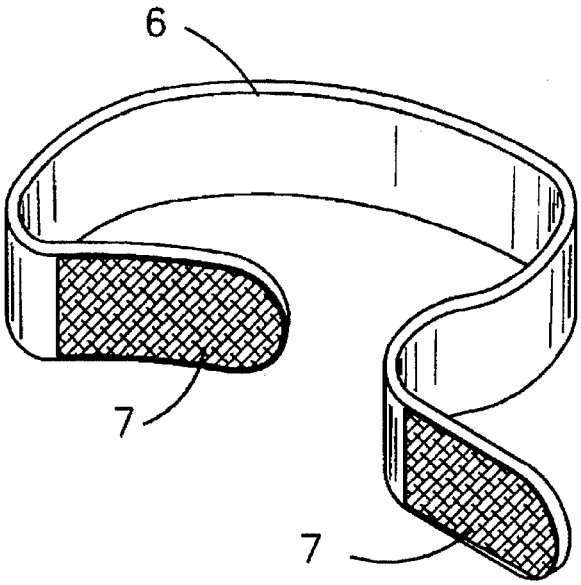
FIG. 4 is a front view of a strap holding means with hook and pile fastening means.

As shown in FIG. 4, the fastening means 7 can be VELCRO (Registered Trademark). The VELCRO (Registered Trademark) fastening means comprises two segments. The first segment is either adhesively attached or sewn on to the first end of the strap and the second segment is attached on the second end of the strap on the side opposite the first segment. In this way, there will be no twisting in the loop that results from utilizing the VELCRO (Registered Trademark) fastening means.

Figure 6:
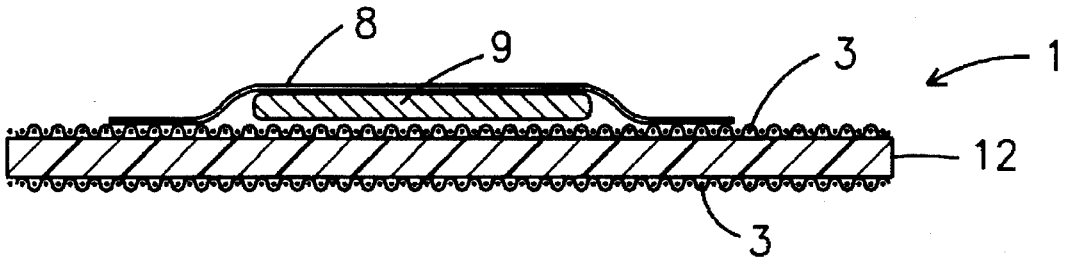
FIG. 6 is a cross-sectional view of a shin protector of FIG. 5.
Figure 5:
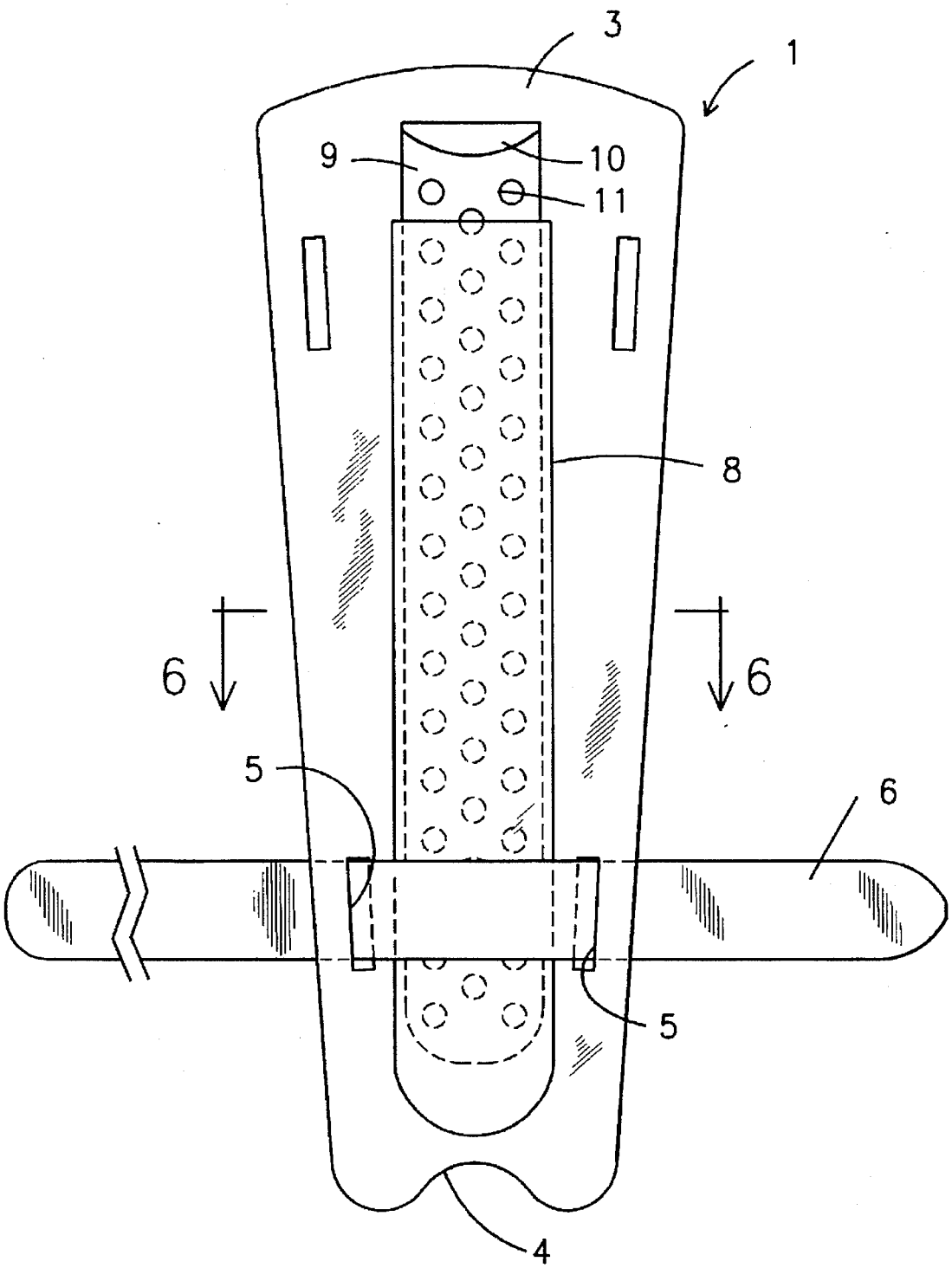
FIG. 5 is a front view of a shin protector with a pocket and supplemental shin guard shaft insert.
Figure 7:
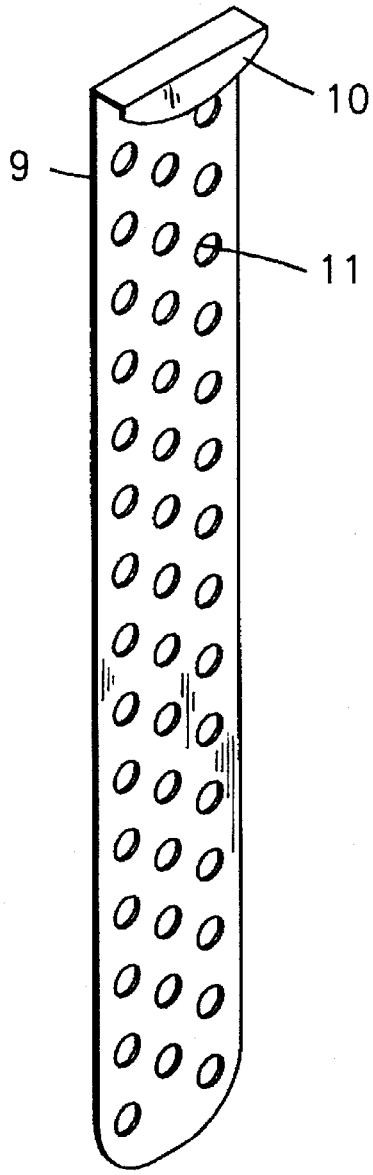
FIG. 7 is an elevated side view of a shin guard shaft insert.

FIGS. 5 and 6 show a front view and a cross-sectional view of a shin protector with a pocket 8 attached to the breathable fabric 3 covering the front side of the pad 1. The pocket 8 is constructed of the same material as the breathable fabric 3 which allows ventilation through the perforations 2. The size of the pocket 8 is such that it can receive a guard shaft 9, as shown in FIG. 7, within it. The pocket 8 is attached to the breathable fabric 3 either through an adhesive such as an epoxy or, alternatively, the pocket 8 can be sewn on to the breathable fabric 3.

The guard shaft 9 which is inserted into the pocket 8 has both a length and width that are smaller than both the length and width of the pad 1. The guard shaft 9 having a preferable thickness of between 1/32"–1/4"; more preferably, between 1/32"–1/8"; can be constructed of a flexible polymer, such as an injection moldable ethylene/methacrylic acid base copolymer, a high density polyethylene copolymer, any of polyolefins, such as polypropylene and polyethylene, polyethylene terephthalate, polystyrene, acrylonitrilestyrene-butadiene polymer, nylon, acetal polymer, polycarbonate, nitrile resins, polyvinyl chloride, polysulfone and other semi-rigid to rigid polymers including multipolymers, polymer blends and polymer laminar constructions thereof having enhanced properties such as impact resistance and smooth surfaces. The material from which the guard shaft 9 is constructed, however, should be sufficiently hard so that the guard shaft 9 can offer the user a greater degree of protection from more serious falls and bumps than can only the pad 1. The guard shaft 9, having an upper end and a lower end corresponding to the respective upper and lower ends of the pad 1, has a curved lip 10 at its upper end such that when the guard shaft 9 is inserted into the pocket 8 the curved lip 10 faces away from the shin area. The curved lip 10 allows the guard shaft 9 to be both easily removed and inserted into the pocket 8. Furthermore, the guard shaft 9 has perforations 11 which may have the same dimensions and pattern as the perforations 2 of the pad 1. Preferably, a column of guard holes 11 is located in the center of the guard 9. This column of guard shaft holes 11 allows the user to easily crease the guard shaft 9 so as to give the guard shaft 9 a slight curvature. The slight curvature of the guard shaft 9 allows it to better fit over the curvature of the leg. By using a material for the breathable fabric 3 and the pocket 8 which allows an air flow through the material in conjunction with holes in both the guard shaft 9 and the pad 1, complete ventilation can be maintained and both heat build-up and moisture accumulation at the surface of the shin will be precluded. Thus, both the degree of protection and the comfort with which it is offered are maximized. The operation of the shin protector will now be explained in greater detail using a shin protector with a pocketed guard as shown in FIGS. 5 and 6 as an example. Both the upper and lower straps of the shin protector are threaded through their respective slots such that each strap extends outwards from the sides of the shin protector. The shin protector is then placed over the shin area such that the recessed lower end of the shin protector fits over the foot arch. Next, the shin protector is deformed so that it conforms to the shape of the leg and the straps are wrapped around the leg (calf area). Using the VELCRO (Registered Trademark) fastening means, the two ends of each strap are fastened together such that the strap forms a loop around the leg and securely holds the shin protector in place. The tension can be varied by fastening the first end of each strap in a different place along the second end. In this way, it can be ensured that the tension in each looped strap will not be great enough to impede the user's blood circulation. Next, the guard shaft 9 is slipped into the pocket 8 such that the curved lip 10 of the guard shaft 9 is facing away from the shin area. The placement of the guard shaft 9 into the pocket 8 is accomplished by gripping the curved lip 10 with one hand and slipping the guard shaft 9 into the pocket 8. However, the guard shaft 9 may or may not be used according to the preference of the user. Once the shin protector is secured to the leg, it can be worn comfortably throughout the day and clothing can be worn over it. To remove the shin protector, the VELCRO (Registered Trademark) fastening means are unfastened and the shin protector is removed from the shin area.

Alternatively, the shin protector as shown in FIG. 6 can be used without fastening straps by simply (a) inserting the guard shaft 9 into the pocket 8 to provide some stiffness, (b) inserting the assembled shin protector with guard shaft into a sock, or placing the assembled shin guard against a shin and then pulling a sock over the shin guard shaft, and then (3) optionally withdrawing the guard shaft 9 from the shin protector.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A shin protector comprising:

a pad having a longitudinal axis and comprising a sheet of impact-absorbing foamed material sandwiched between outer layers of breathable fabric, wherein the thickness of the foamed material layer is about 1/16 to 1/4 inches, wherein the total weight of said shin protector is 1–6 ounces, said pad shaped to fit over the skin of a user, and having a pocket extending longitudinally along substantially the longitudinal length;

a guard shaft of stiff material adapted for insertion in said pocket;

wherein said guard shaft has an upper end and a lower end, and wherein said upper end is curved outward to facilitate gripping by fingertips.

* * * * *